US005875910A

United States Patent [19]

Scelsa

[11] Patent Number: 5,875,910

[45] Date of Patent: Mar. 2, 1999

[54] ORCHARD BIN CORNERS AND JOINING BRACKETS

[75] Inventor: Joseph Scelsa, Langley, Canada

[73] Assignee: Advance Wire Products Ltd., Burnaby, Canada

[21] Appl. No.: 919,493

[22] Filed: Aug. 28, 1997

[51] Int. Cl.[6] ..... B65D 6/22

[52] U.S. Cl. ..... 217/65; 217/69; 220/4.33

[58] Field of Search ..... 220/4.33; 217/69, 217/65

[56] References Cited

U.S. PATENT DOCUMENTS

| | | | |
|---|---|---|---|
| 1,587,809 | 6/1926 | Walker | 217/69 |
| 2,310,063 | 2/1943 | Browne et al. | 217/40 |
| 2,366,532 | 1/1945 | Jones et al. | 217/69 |
| 2,423,955 | 7/1947 | Widener | 220/4.33 |
| 2,578,644 | 12/1951 | Mautner | 217/69 |
| 3,958,712 | 5/1976 | Martin | 217/40 |
| 3,962,761 | 6/1976 | Broughner | 27/10 |
| 3,966,285 | 6/1976 | Porch et al. | 220/4.33 |
| 3,989,157 | 11/1976 | Veenema | 220/4 F |
| 4,671,422 | 6/1987 | Bjorklund | 220/4 F |
| 4,840,440 | 6/1989 | Dieter | 312/140 |
| 5,199,589 | 4/1993 | Noble | 220/7 |
| 5,429,259 | 7/1995 | Robin | 217/65 |

*Primary Examiner*—Joseph M. Moy
*Attorney, Agent, or Firm*—Miller, Nash, Wiener, Hager & Carlsen

[57] ABSTRACT

Orchard bins for the retail food sales industry have special corner members and joining brackets that allow assembly without the use of tools, and also permit disassembly for storage. The connector system for interconnecting two panels together has a connector member with a first surface for positioning on one panel vertical strip and a second surface for positioning on a second panel vertical strip. The first surface and the second surface of the connector member each have at least one cleat aperture thereon, and at least one cleat is provided for attachment to the first panel vertical strip and at least a further cleat for attachment to the second panel vertical strip, the cleats positioned to engage the cleat apertures in the first and second surfaces of the connector member.

20 Claims, 3 Drawing Sheets

ORCHARD BIN CORNERS AND JOINING BRACKETS

FIELD OF THE INVENTION

The present invention relates to bins and more specifically to bins that can be assembled using corner members and joining brackets with standard sized panels. Quick connection cleats on the panels attach to the corner members and joining brackets.

BACKGROUND OF THE INVENTION

In the retail food sales industry there is a need for bins to store and display produce. Most bins are made so that they can be assembled and disassembled, thus they can be used at different store locations and at different times of the year. When the bins are not needed, the components can be stored. Present designs for orchard bins generally use removable brackets with panels. Tools are required to attach and detach the brackets to the panels which can be time consuming if a particular tool is missing. Some designs overcome the use of tools by using metal straps with hand-locking bolts to secure the panels together. Such bins are still time consuming to assemble and disassemble and furthermore the panels cannot generally be joined together in an infinite number of ways to provide larger or smaller bins. There is a need for a system of connecting standard sized panels to form bins of varying sizes that is both relatively quick and easy to assemble and disassemble and does not require the use of special tools.

SUMMARY OF THE INVENTION

It is an aim of the present invention to provide orchard bin corner members and joining brackets that can be used with substantially standard sized panels to assemble different sizes of bins. Both the corner members and the joining brackets have cleat apertures therein and cleats are attached to inside faces of the panels which engage in the apertures either in the corner members or in the joining brackets to join the panels together and form a bin.

The present invention provides a connector system for interconnecting a first panel and a second panel comprising a connector member having a first surface for positioning on a first panel vertical strip and a second surface for positioning on a second panel vertical strip, the first surface and the second surface of the connector member each having at least one cleat aperture therein, and at least one cleat for attachment to the first panel vertical strip and at least a further cleat for attachment to the second panel vertical strip, the one cleat and the further cleat positioned to engage the cleat aperture in the first surface and the cleat aperture in the second surface of the connector member.

The present invention also provides a combination of a connector joining two panels together comprising a first panel having a first vertical strip adjacent a first panel side edge, a second panel having a second vertical strip adjacent a second panel side edge, a connector member having a first surface positioned on the first vertical strip of the first panel and a second surface positioned on the second vertical strip of the second panel, the first surface and the second surface of the connector member each having at least one cleat aperture therein, and at least one cleat attached to the first vertical strip of the first panel and at least a further cleat attached to the second vertical strip of the second panel at a location such that the one cleat and the further cleat each engage in the cleat aperture to hold the first panel and the second panel together with the connector member.

BRIEF DESCRIPTION OF THE DRAWINGS

In drawings which illustrate embodiments of the present invention.

DESCRIPTION OF THE PREFERRED EMBODIMENTS

Figure 1:
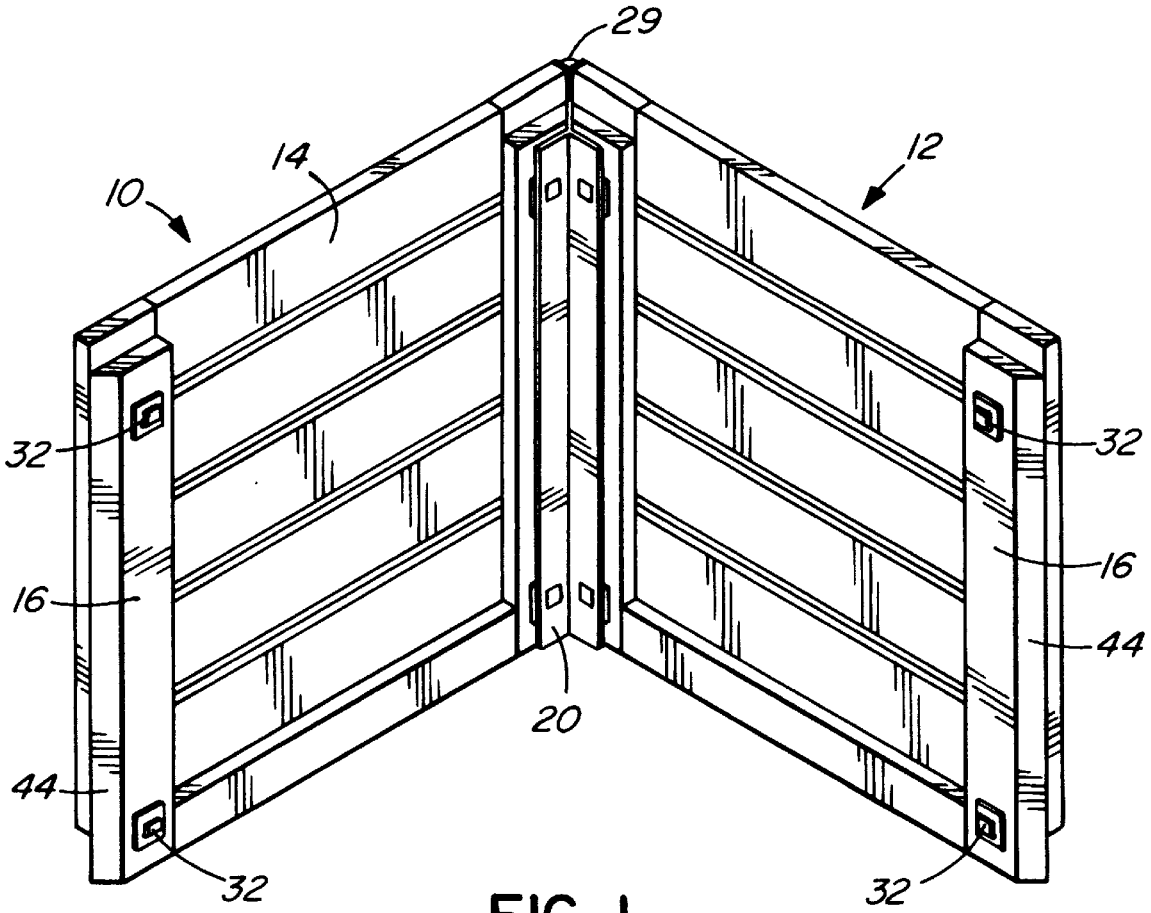
FIG. 1 is an isometric view showing two panels joined with a corner member according to one embodiment of the present invention.

Orchard bins are generally made of a series of identical sized panels that are joined together by the connectors of the present invention. As shown in FIG. 1, a first panel 10 and a second panel 12 each have a series of horizontal boards 14 with vertical side strips 16 on each side. In the embodiments shown, the side strips 16 act as reinforcing for the horizontal boards 14 to form the panel 10. The construction of these panels does not form part of the present invention.

Figure 2:
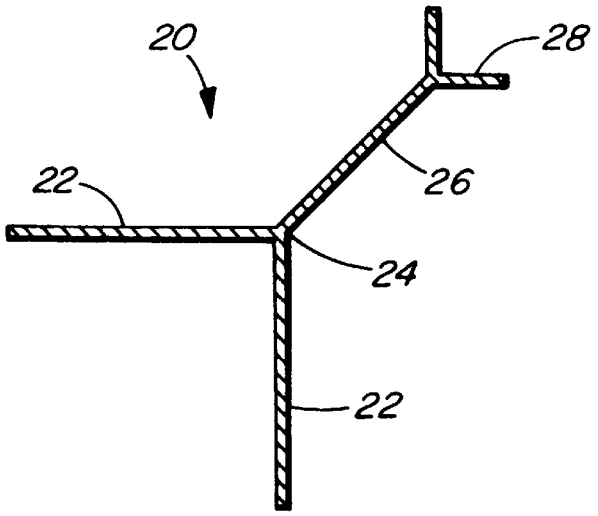
FIG. 2 is a cross-sectional view showing the corner member of FIG. 1.
Figure 3:
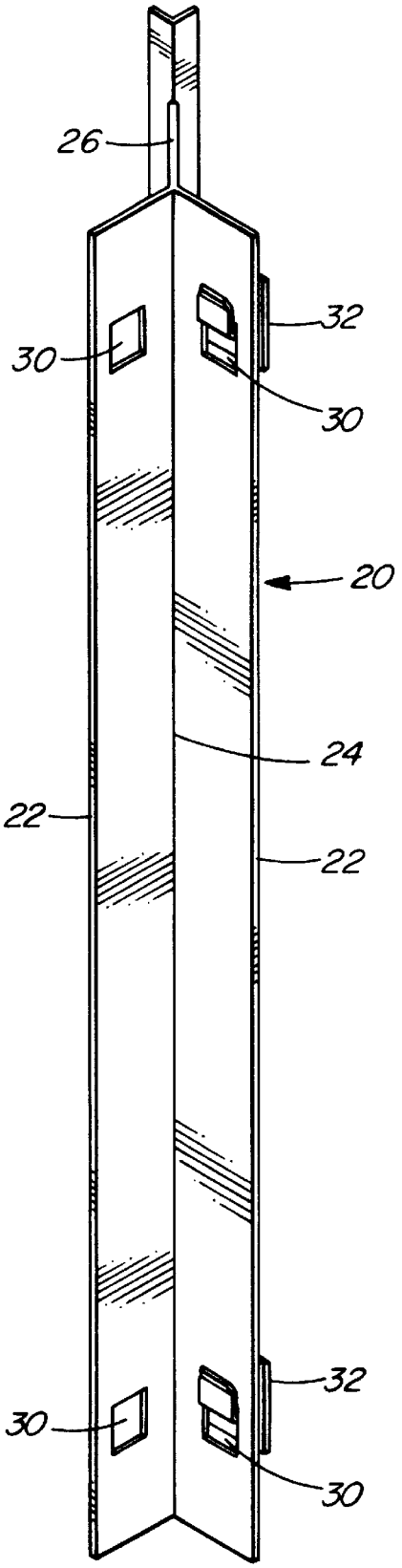
FIG. 3 is an isometric view showing the corner member of FIG. 1.

FIG. 1 illustrates an elongate corner member 20 shown in more detail in FIGS. 2 and 3. The corner member 20 is preferably formed of an aluminum extrusion and has two arms 22 arranged in a V-shape extending from a vertex 24. A Y-shaped brace member 26 extends back from the vertex 24 away from the two arms 22 bisecting the angle between the arms 22. As shown in FIG. 3, a small angle 28 at the end of the brace member 26 extends up above the top of the corner member 20. In effect the small angle 28 extends to the top of the panels 10,12 as shown in FIG. 1. As can be seen in FIG. 1, the vertical side strips 16 do not extend up to the top of the panels 10,12 and thus the corner member 20 terminates just prior to the top of these vertical side strips 16.

Figure 4:
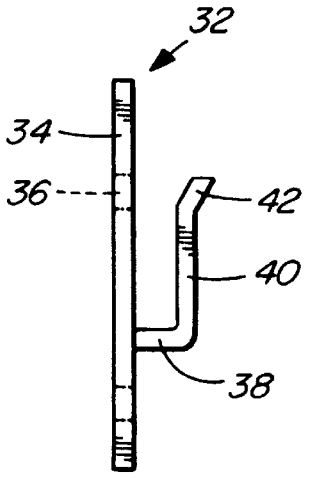
FIG. 4 is a side view showing a cleat according to one embodiment of the present invention.
Figure 5:
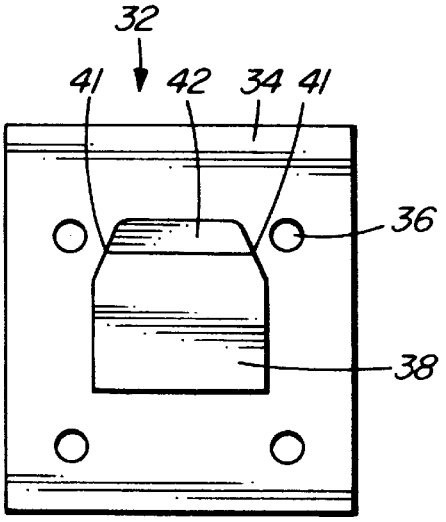
FIG. 5 is an elevational view showing the cleat of FIG. 4.

The elongate corner member 20 has two cleat apertures 30 in both arms 22. These cleat apertures 30 are positioned to engage with cleats 32 as attached to the panels 10,12 shown in FIG. 1. The cleats 30 are attached directly to the vertical side strips 16 of the panels. The cleats 30 are all positioned at the same position on the vertical side strips 16 for all the panels 10. Thus all corner members 20 can be locked to all panels 10. Details of the cleats 32 are shown in FIGS. 4 and 5. The cleat 32 comprises a base plate 34 which is substantially rectangular and has four attachment holes 36 in the corners for attachment to the vertical side strips 16 of the panels 10. Screws, bolts or other attachment devices may be used for connecting the cleats 32 to the vertical side strips 16 of the panels 10. In another embodiment the base plates 34 can be attached by adhesive or other suitable fastening devices.

The cleat 32 has a hook member which has a perpendicular portion 38 extending out from the base plate 34 of the cleat 32 and a flat vertical portion 40 parallel to the base plate 34 which extends up and has tapered ends and a distal end piece 42 sloped away from the base plate 34 to provide a guide for guiding the cleat 32 to engage in the arm 22 of the corner member 20 through the cleat aperture 30.

The panels 10 are arranged to have the cleats 32 attached to the vertical side strips 16 on both sides and, thus the cleats 32 become an integral part of each panel 10. In order to join the panels 10 together in a corner configuration, as shown in FIG. 1, the panels 10 are first all placed together and the corner member 20 is then pushed into place between the ends of the two panels 10. In the embodiment shown the vertical side strips 16 have bevelled edges 44 which fit against the surface of the corner brace member 26. The small angle 28 holds a rounded plastic corner piece 29 for a rounded flush exterior corner. As the corner member 20 is pushed down between the panels 10, the cleat apertures 30 in the corner members 20 pass over the cleats 32, the cleats 32 then pass through the cleat apertures 30 and as the corner member 20 is pushed downwards the cleats 30 engage the arms 22 directly above the cleat apertures 30 and the panels are held in a corner configuration as shown in FIG. 1.

If it is a matter of making a bin with four panels, then four corner members 20 are provided for each of the four corners and the bin is assembled by installing the four corner members 20.

Figure 6:
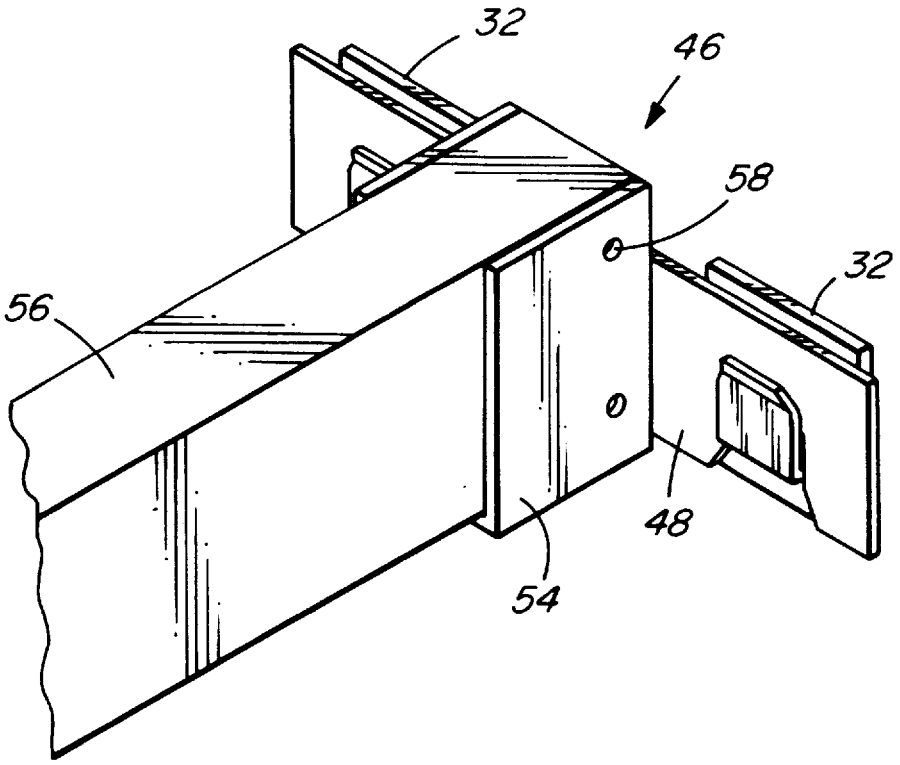
FIG. 6 is an isometric view showing the joining bracket for connecting panels together in line according to another embodiment of the present invention.
Figure 7:
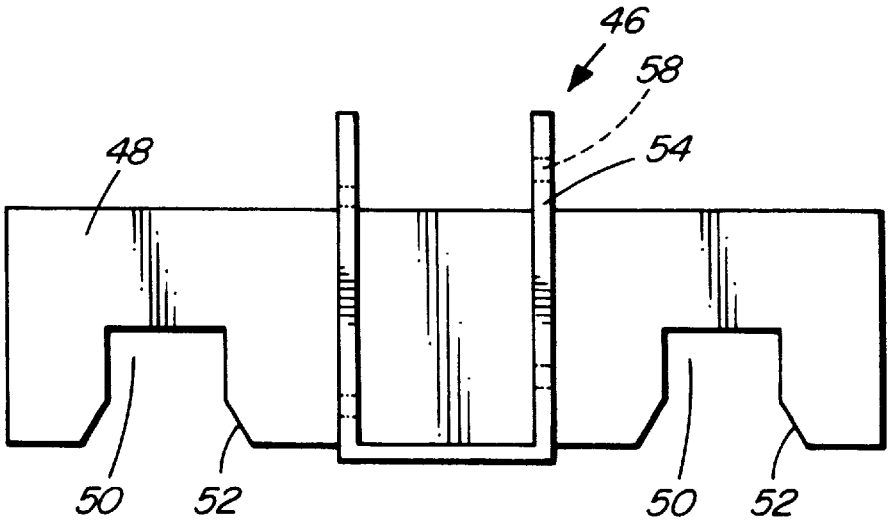
FIG. 7 is an elevational view showing the joining bracket of FIG. 6.

In another embodiment it may be necessary to make a bin which has two or three panels per side in which case it is necessary to join the panels 10 together so that they are coplanar. In order to do this a joining bracket 46, as shown in FIGS. 6 and 7, is provided. The joining bracket 46 is made of a flat steel plate 48 having sufficient length to span between two panels 10 when placed side-by-side in coplanar relationship. The plate 48 has notches 50 at each side with tapered openings 52 as shown in FIG. 7. These notches 52 represent the cleat openings and, as shown in FIG. 6, engage with the two cleats 32 positioned on adjacent panel vertical side strips 16. As the panels 10 have cleats 32 at both the top and bottom of the vertical side strips 16, then two joining brackets 46 are provided to join panels 10 together in a coplanar arrangement.

In the center of the plate 48 of the joining bracket 46 is attached a channel section 54, preferably welded to the plate 48 and extending out away from the panels 10. The channel section 54 holds a crossbar 56 which is preferably wood, steel or the like. Holes 58 in the channel section 54 are provided for screws, welds, rivets or the like to attach the crossbar 56 in the channel section 54.

The corner member 20 is preferably extruded aluminum. The other members, the cleat 32 and the joining bracket 46, are preferably made of sheet steel, although other materials such as aluminum, plastic and the like may be used. It will be understood that by using the joining brackets 46 several panels 10 may be assembled side-by-side in both directions. Crossbars 56 extend across the top of the panels and are held to the joining brackets 46. The crossbars 56 have the same length representing the number of panels that are in the side parallel to the crossbars 56. The bin may be made square or rectangular as desired.

Various changes may be made to the embodiments shown herein without departing from the scope of the present invention which is limited only by the following claims.

I claim:

1. A connector system for interconnecting a first panel and a second panel comprising:

a connector member having a first surface for positioning on a first panel vertical strip and a second surface for positioning on a second panel vertical strip, the first surface and the second surface of the connector member each having at least one cleat aperture therein, and at least one cleat for attachment to the first panel vertical strip and at least a further cleat for attachment to the second panel vertical strip, the one cleat and the further cleat positioned to engage the cleat aperture in the first surface and the cleat aperture in the second surface of the connector member.

2. The connector system according to claim 1 wherein the cleat includes a cleat base with attachments to the first panel vertical strip or the second panel vertical strip, a hook portion extending from the cleat base for engagement in the cleat aperture of the elongate connector member.

3. The connector system according to claim 2 wherein the hook portion includes a spaced portion extending perpendicular from the cleat base joined to a retaining portion substantially parallel to the cleat base, the retaining portion having a tapered distal end piece sloped away from the cleat base.

4. The connector system according to claim 1 wherein the connector member is an elongate corner member with a first surface at an angle to the second surface, and having a length approximately the same height as the panel, the elongate corner member having two cleat apertures therein to match cleats at the top and bottom of the first panel vertical strip and the second panel vertical strip.

5. The connector system according to claim 4 wherein the corner member has a generally V-shaped cross-section with a first arm having the first surface thereon and a second arm having the second surface thereon, the first arm and the second arm joining at a vertex and wherein a spine member having a substantially Y-shaped cross-section extends back from the vertex bisecting an angle between the first arm and the second arm.

6. The connector system according to claim 5 wherein the angle between the first arm and the second arm is 90°.

7. The connector system according to claim 5 wherein the corner member is formed of an aluminum extrusion.

8. The connector system according to claim 2 wherein the cleat is formed of sheet steel.

9. The connector system according to claim 1 wherein the connector member is a joining bracket with the first surface and the second surface coplanar so the first panel and the second panel are assembled substantially in line.

10. The connector system according to claim 9 wherein the cleat aperture of the joining bracket is in the first surface and the second surface and includes a notch with tapered edges to engage the cleat.

11. The connector system according to claim 10 wherein the joining bracket is formed of sheet steel.

12. The connector system according to claim 10 wherein the joining bracket has a channel-shaped section extending generally perpendicular from the bracket between the first surface and the second surface, the channel-shaped section to receive a crossbar.

13. A combination of a connector joining two panels together comprising:

a first panel having a first vertical strip adjacent a first panel side edge;

a second panel having a second vertical strip adjacent a second panel side edge;

a connector member having a first surface positioned on the first vertical strip of the first panel and a second surface positioned on the second vertical strip of the second panel, the first surface and the second surface of the connector member each having at least one cleat aperture therein, and at least one cleat attached to the first vertical strip of the first panel and at least a further cleat attached to the second vertical strip of the second panel at a location such that the one cleat and the further cleat each engage in the cleat aperture to hold the first panel and the second panel together with the connector member.

14. The combination according to claim 13 wherein the cleat includes a cleat base with attachments to the first panel vertical strip and the second panel vertical strip, a hook portion extending from the cleat base engaging in the cleat aperture of the elongate connector member.

15. The combination according to claim 14 wherein the hook portion includes a spaced portion extending perpendicular from the cleat base joined to a retaining portion substantially parallel to the cleat base, the retaining portion having a tapered distal end piece sloped away from the cleat base.

16. The combination according to claim 13 wherein the connector member is an elongate corner member with a first surface at an angle to the second surface, and having a length approximately the same height as the panel, the elongate corner member having two cleat apertures therein connected to two cleats in each of the first vertical strip of the first panel and the second vertical strip of the second panel.

17. The combination according to claim 16 wherein the corner member has a generally V-shaped cross-section with a first arm having the first surface thereon and a second arm having the second surface thereon, the first arm and the second arm joining at a vertex and a spine member having a substantially Y-shaped cross-sectional extends back from the vertex bisecting an angle between the first arm and the second arm.

18. The combination according to claim 13 wherein the connector member is a joining bracket with the first surface and the second surface coplanar so the first panel and the second panel are substantially in line.

19. The combination according to claim 18 wherein the cleat aperture of the joining bracket is in the first surface and the second surface and includes a notch with tapered edges to engage the cleat.

20. The combination according to claim 19 wherein the joining bracket has a channel-shaped section extending generally perpendicular from the bracket between the first surface and the second surface, the channel-shaped section to receive a crossbar.

* * * * *